United States Patent [19]

Robinson

[11] 3,951,028

[45] Apr. 20, 1976

[54] ELECTRONIC ORGAN AND METHOD OF OPERATION

[75] Inventor: John William Robinson, Jasper, Ind.

[73] Assignee: Kimball International, Inc., Jasper, Ind.

[22] Filed: Oct. 23, 1974

[21] Appl. No.: 517,215

[52] U.S. Cl. ..... 84/1.01; 84/1.03; 84/115

[51] Int. Cl.[2] ..... G10F 5/00; G10H 1/00

[58] Field of Search ..... 84/1.01, 1.03, 115

[56] References Cited

UNITED STATES PATENTS

| | | | |
|---|---|---|---|
| 3,610,799 | 10/1971 | Watson | 84/1.01 |
| 3,683,096 | 8/1972 | Peterson et al. | 84/115 |
| 3,697,661 | 10/1972 | Deutsch | 84/1.01 |
| 3,743,755 | 7/1973 | Watson | 84/1.01 |
| 3,746,773 | 7/1973 | Uetrecht | 84/1.01 |
| 3,789,719 | 2/1974 | Maillet | 84/115 |
| 3,836,909 | 9/1974 | Cockerell | 84/1.01 X |

*Primary Examiner*—L. T. Hix
*Assistant Examiner*—Stanley J. Witkowski
*Attorney, Agent, or Firm*—Melvin A. Crosby

[57] ABSTRACT

An electronic organ, and a method of operation, in which the keyboard is scanned and a series of signals is established in conformity with the pattern of keys that are depressed. The signal pattern is stored in a plurality of shifted positions and the composite pattern is then employed for actuating keyers to key signal tones of respective pitch. In this manner, a plurality of organ footages can be obtained in a simple and effective manner.

13 Claims, 12 Drawing Figures

ELECTRONIC ORGAN AND METHOD OF OPERATION

The present invention relates to electronic organs, and to a method of operation of the organ, and is particularly concerned with a novel circuit arrangement for, and method of, developing a plurality of organ footages in a simple, effective, and inexpensive manner.

In conventional electronic organs, each footage developed requires a considerable amount of wiring and other components in the form of switches and the like, all of which adds substantially to the expense of constructing the organ and, thus, limits the number of voices which can be obtained within reasonable economic limits.

BRIEF SUMMARY OF THE INVENTION

According to the present invention an organ keyboard of a predetermined length, say, 61 keys, is provided. A tone generator is also provided generating, say, 109 pitches. Each tone generator terminal at a respective pitch is connected by an electronic keyer with the electroacoustic transducer system of the organ. The tone signals generated are usually in the form of square waves and the transducer system normally consists of voice formant circuit means to convert the incoming signals to a desired wave form, amplifying means for amplifying the signals, and speaker means to convert the signals to sound.

According to the present invention, the keyboard of the organ is repetitively scanned at high speed and on each scan of the keyboard a data stream comprising a series of signals or data items in respective time slots is established in which first signals correspond to depressed keys and second signals correspond to nondepressed keys. The second signals are without effect, while the distribution of the first signals in the series of signals corresponds to the pattern of the depressed keys of the keyboard.

The series of signals, or data stream referred to is stored in predetermined shifted positions thereof to arrive at a composite signal, and this composite signal is employed for actuating the keyers for keying respective pitches. In each position of the data stream, the respective data items thereof are in one to one relation to keyers of the organ.

Referring to the shifting and storing of the pattern of data signals taken from the keyboard, if this pattern were to be employed for actuating the keyers corresponding to the lowermost pitch tones, the pitches keyed would correspond to the sixteen foot stop of the organ. If, now, the said pattern were to be shifted in the direction of increasing pitch a distance of twelve half steps, with each half step moving the data stream a distance equal to the spacing between adjacent keyers, and the same pattern were then employed for actuating keyers, the keyers actuated would correspond to the eight foot organ stop.

From the foregoing it will be evident that, commencing with the first mentioned position of the pattern, or stream, of keyboard data, and which could correspond to a footage of sixteen feet, each half step that the pattern is shifted in the direction of increasing pitch would provide for a footage equal to 16 feet divided by the twelfth root of two multiplied by the number of steps the pattern has been shifted from the starting position thereof.

It will at this time be evident that a multiplicity of footages can readily be obtained by shifting the pattern of keyboard data, storing the pattern in selected shifted positions thereof, and employing the thus derived composite pattern for actuating the keyers.

In the particular example referred to above, and which is the example employed in the following detailed specification, there are 61 keys in the keyboard and 109 keyers each keying a respective pitch. The keyboard data thus includes 61 signals, or data items consisting of first effective signals corresponding to depressed keys and second ineffective signals corresponding to nondepressed keys. The second signals are referred to merely to indicate that the first signals are distributed in respective time slots in the series of signals forming the keyboard data according to the same pattern as the depressed keys are distributed along the keyboard.

With 61 keys and 109 keyers, and with the keyboard data streams aligned with the keyers at one end of the series of keyers, the keyboard data can be shifted 48 half steps to make up a composite signal of 109 bits, or signal items. The composite signal is made up in a storage unit of one hundred nine data stations, some of which will contain first signals and others of which will contain second signals with the keyers being actuated in conformity with the distribution of the aforesaid first signals.

It will be understood that the keyboard is scanned quite rapidly and repetitively and the signals are processed in such a manner that the keyers are operated via a memory latch so that the sound produced by the organ conforms to that produced by a conventional organ.

In applying the invention, it is convenient to feed the streams of keyboard data into one end of a shift register having a hundred nine data stations, or stages, and to pulse the data thus supplied longitudinally in the shift regsiter until the uppermost data bit reaches the other end of the shift register.

In each shifted position of the keyboard data in the shift register corresponding to a selected footage, each first signal (referred to hereinafter as "a key down signal") in the stream of data in the shift register is entered in parallel motion into a respective first latch, referred to as a "temporary" latch. Each first signal thus supplied to the respective temporary latch is clamped therein. After the data in the shift register has shifted 48 steps along the shift register with each step conforming to a half pitch of the musical scale, the composite signal which is now set up in the temporary latches is entered in parallel motion into respective second latches, referred to as "memory" latches. The temporary latches are so referred to because they retain data supplied thereto only temporarily. The memory latches, on the other hand, receive the entire input thereto at one time and retain the data thus supplied until a fresh body of data is supplied thereto. The memory latches are connected to respective keyers and signals therein conforming to the aforementioned first signals moved from the shift register to the temporary latches and then into the memory latches will actuate the corresponding keyers. The actuated keyers will remain in actuated condition until the pattern in the memory latches is altered by different data transmitted thereto from the temporary latches.

The feeding of the stream of keyboard data into the shift register is interrupted at the end of one complete scan of the keyboard, and is not again resumed until the temporary latches have received an entire composite pattern from the shift register and the composite pattern has been entered into the memory latches. The temporary latches are then cleared of the composite data and the keyboard is again scanned.

When the keyboard data has been shifted in the shift register so as successively to occupy all of its shifted positions, and a set of composite data has been established in the temporary latches of 109 bits and this composite signal is then entered into the memory latches; the temporary latches are then cleared; and a new stream of keyboard data is supplied to the shift register and the cycle described above is repeated.

During the time that the aforementioned cycle of operations is being carried out, the footage switches of the organ are being electronically scanned. As has been mentioned, each footage switch corresponds to a predetermined organ footage and, thus, corresponds to a predetermined shifted position of the keyboard data in the shift register. The footage switches are scanned and signals are established corresponding to the actuated condition of each thereof. The signals from the footage switches consist of a first effective signal when the respective switch is in effective position and a second ineffective signal when the switch is in ineffective position.

Counting means are provided for supplying counts conforming to the shifted positions of the stream of keyboard data in the shift register and when a count of the counting means coincides with an effective signal from a footage switch; a pulse is supplied to the clock terminal of each temporary latch so that the data in the shift register will be entered in parallel motion into the temporary latches. In this manner a composite signal is built up in the temporary latches in conformity with, (1) the depressed keys of the keyboard; and (2) the footage switches which are in effective position.

In the foregoing it has been mentioned that the stream of keyboard data is placed in the shift register at the lower pitch end thereof and shifted toward the higher pitch end, but it will be understood that the keyboard data could be inserted into the shift register at the higher pitch end thereof and shifted toward the lower pitch end. If the former is the case, the first footage switch checked is the sixteen foot switch while, if the latter is the case, the one foot footage switch is the first one checked.

From the foregoing it will be apparent that the primary objective of the present invention is the provision of electronic organ circuitry which permits the development of a multiplicity of organ footages in a simple and inexpensive manner.

Another objective of the present invention is the provision of organ circuitry which results in the elimination of wiring and switches and similar components thereby permitting the organ to be constructed more economically.

A still further object of the present invention is the provision of a method of operating an organ which permits the generation of a multiplicity of footages without requiring a great deal of wiring and many switches and other components and the like conventionally encountered in complex organ circuits.

The exact nature of the present invention and the manner in which the foregoing objectives are achieved will become more apparent upon reference to the following detailed description taken in connection with the accompanying drawings in which.

Figure 1:
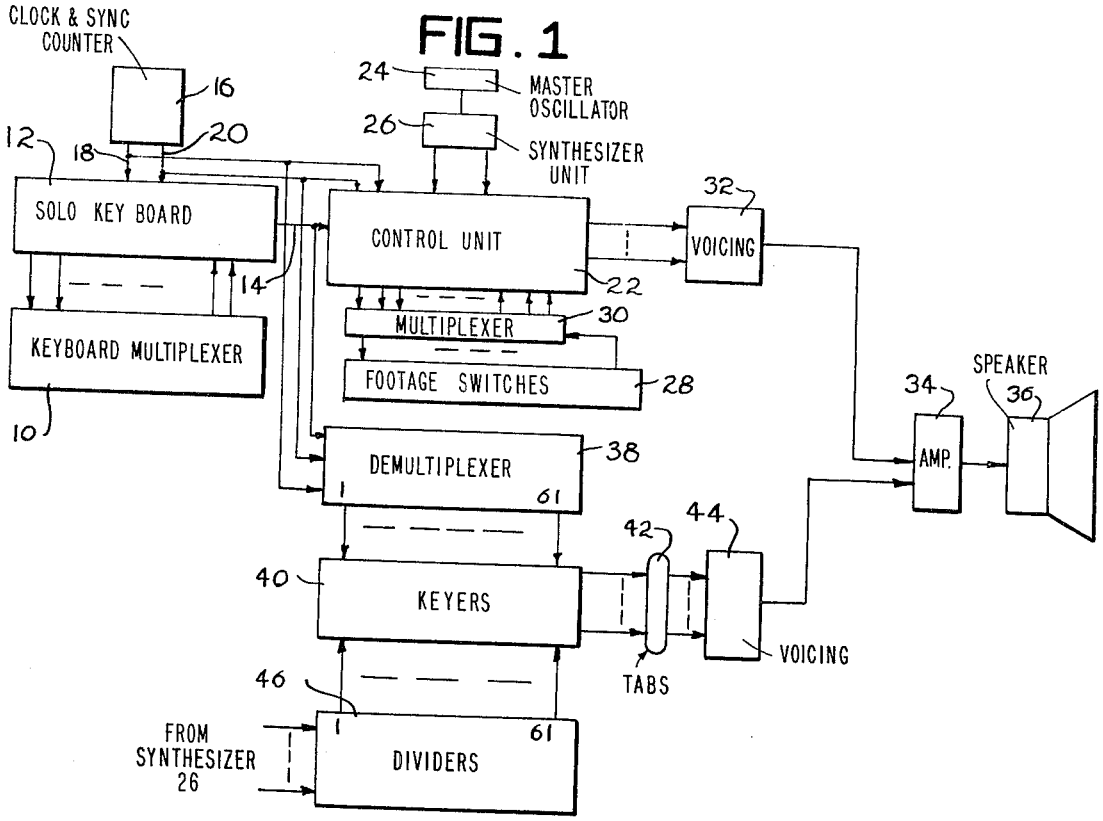
FIG. 1 is a simplified schematic representation of an organ circuit embodying the circuit of the present invention and adapted for practicing the method of the present invention.

DETAILED DESCRIPTION OF THE INVENTION:

FIG. 1 illustrates, extremely schematically, the portion of the organ circuit with which the present invention is concerned. In the following description, each circuit component, or chip, is identified by the catalogue number by which it is identified in the TTL Data Book for Design Engineers of Texas Instruments Inc.-1973.

In the drawings, 10 represents the solo keyboard of the instrument and is made up of 61 keys as has been mentioned. Associated with the keyboard 10 is a multiplexer system 12 which scans the keyboard and supplies to line 14 a data stream in the form of a series of data items, or bits, in respective time slots and consisting of first signals (Key down signals) corresponding to depressed keys, and second signals corresponding to undepressed keys. Line 14, thus, receives a series of data signals in respective time slots and conforming in pattern to that of the depressed keys of the solo manual. As mentioned previously, the second signals are ineffective signals while the first signals are effective and, when processed, cause keyers to be actuated.

A master clock is illustrated at 16 in FIG. 1 and has an output clock line 20. The clock drives a sync counter 100 having a sync output line 18.

The data on line 14 is supplied to a processing unit generally indicated by rectangle 22 and described more fully hereinafter, and which unit is connected to the sync line 18 and clock line 20. Further connected to unit 22 is a tone signal supply system consisting of a master oscillator 24 and a synthesizer unit 26 which develops the range of pitches necessary.

The unit 22 is connected with a bank of footage switches 28 and interposed between the bank of footage switches 28 and unit 22 is a circuit 30 in which signals are established corresponding to the actuated ones of footage switches 28 as will be explained hereinafter.

The output from unit 22 is conveyed to a voice formant circuit means 32 and therefrom via amplifier means 34 to speaker means 36. Circuit unit 22, as will be seen hereinafter, embodies a shift register and latches for temporary data storage and memory latches.

The signal information on line 14 is also supplied to a demultiplexer 38 which also receives signals from clock line 20. The demultiplexed output from demultiplexer 38 actuates keyers of a bank of keyers at 40 and from which signals are supplied via voice tab switches 42 to further voice formant circuits 44 and from which the signals are supplied to amplifier means 34.

The tone signal supply to keyers 40 is derived from the frequency dividers 46 that are supplied from the output side of synthesizer 26 and the aforesaid output from dividers 46 is supplied to the input sides of the keyers at 40. Components 38, 40, 42, 44, and 46 form no part of the present invention.

Figure 2:
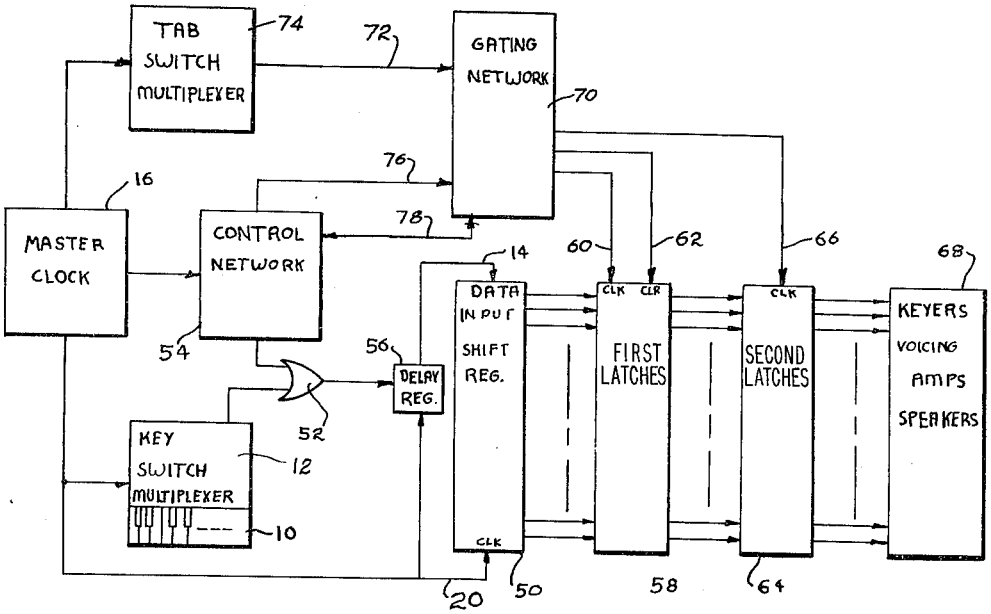
FIG. 2 is a block diagram of an organ circuit showing the present invention in slightly more detail.

The circuit system of unit 22 and certain other components are more fully illustrated in FIG. 2. FIG. 2 shows a shift register at 50 (74198) to which the multiplexed signal data from multiplexer 12 is supplied via line 14. The multiplexer itself, which is indicated at 12 in FIG. 1, is indicated by the reference numeral 12 in FIG. 2 and supplies the output to an input of an OR gate 52, the other input of which is supplied from one output of a flip-flop unit 110 to be described hereinafter. Furthermore, interposed between the output side of OR gate 52 and line 14 is a one bit delay register 56 (74194) the purpose of which will be explained hereinafter.

Shift register 50 is 109 bits long, which is to say that the shift register has 109 data stations, or stages, therein. The keyboard 10 has 61 keys therein so that on one scan of the keyboard a stream of 61 data items, or bits, is inserted into one end of the shift register. This data is supplied in serial form, namely, with the data bits in respective time slots, into the one end of the shift register and is continuously entered into the shift register and pulsed toward the opposite end of the shift register by the pulses supplied to the shift register via clock line 20.

The shift register 50 is parallel connected to a series of one hundred nine latches 58 (74175), referred to as "temporary" latch means and which latch means provide for temporary storage of data. The 109 temporary latches corresponding to the number of data stations, or stages, in shift register 50.

Each of the temporary latches 58 is provided with a clock terminal to which line 60 is connected and a clear terminal to which line 62 is connected. When clock line 60 is pulsed, data from the shift register is entered in parallel motion into the temporary latches and, when line 62 is pulsed, data in the temporary latches is cleared therefrom.

The temporary latches 58 are parallel connected with respective latches 64 (74174), referred to as "memory" latch means, and each having a clock terminal connected to a line 66. When line 66 is pulsed, the data at the output side of temporary latches 58 is entered in parallel flow into respective memory latches 64. The data in memory latches 64 is continuously supplied to a plurality of keyers 146, 109 in number and each interposed between a respective output of the tone generator and the amplifier and speaker means and, thus, keying a respective pitch.

The aforesaid lines 60, 62 and 66 are connected to a gating network indicated at 70 in FIG. 2 and forming a part of circuit 30 of FIG. 1 and which gating network has one control cable 72 connected thereto which is derived from a footage switch multiplexer system forming a part of circuit 30 and which receives pulses from master clock 16.

A further control cable 76 leads into the gating network 70 and comes from a counter encoder-decoder combination 55 which is supplied by master clock 16. Feed back line 78 is provided leading from gating network 70 back one input terminal of the flip-flop 110 forming a part of circuit 22.

Figure 3:
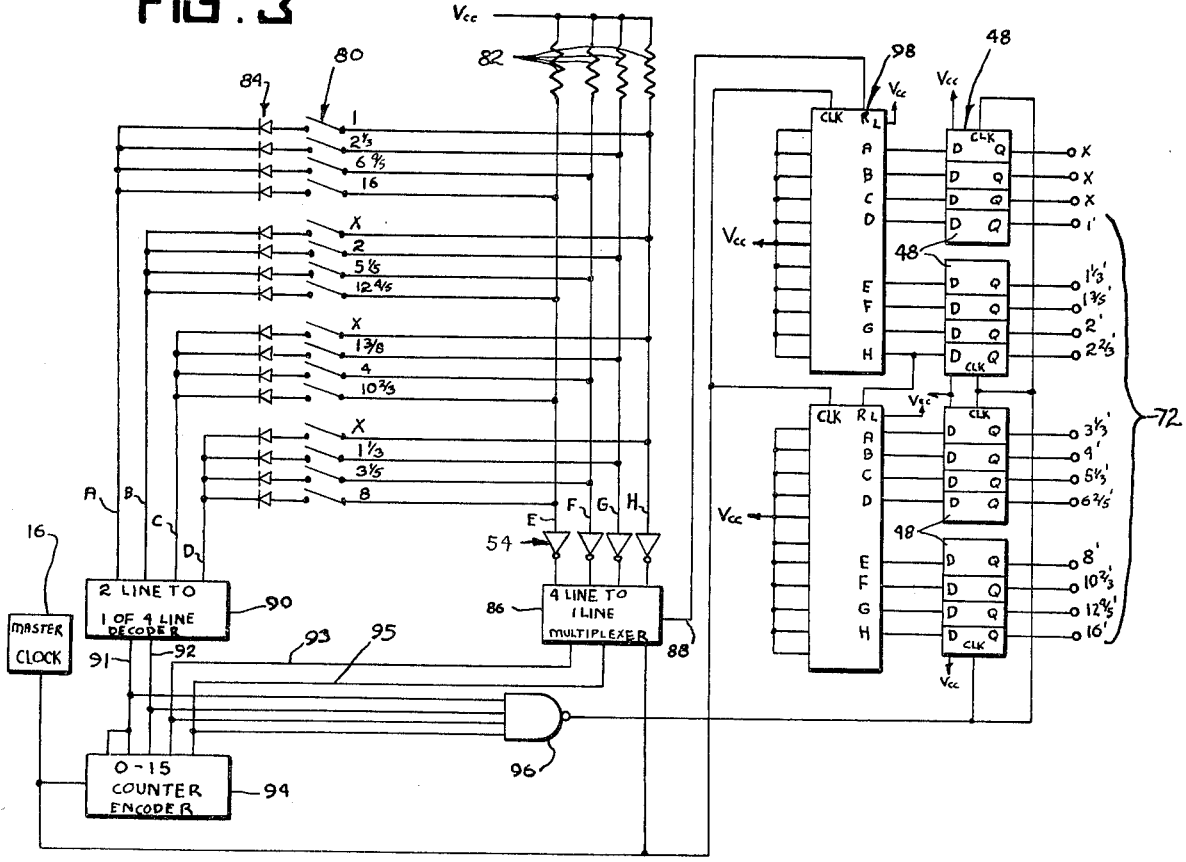
FIG. 3 is a schematic of the circuit used to multiplex the footage switch data.

FIG. 3 illustrates schematically the manner in which the footage switch information is established in circuit 30 and supplied to a plurality of terminals corresponding to cable 72 of FIG. 2.

In FIG. 3, the tab, or footage switches, designated at 28 in FIG. 1, will be seen to comprise a plurality of selector switches arranged in a vertical row at 80. Each switch has an open, ineffective, position and a closed, effective, position. The tab switches are arranged in groups of four each with each switch corresponding to a predetermined footage. In the lower three groups, the uppermost tab is not employed because the footages which would be represented thereby would be less than one foot and one foot is the lowermost footage desired.

The four footage switches of the uppermost group in FIG. 3 correspond to footages of 1 foot, 2 ⅓ feet, 6 2/5 feet and 16 feet, respectively. In the next group, the three effective tab switches corresponding to 2 feet, 5 1/5 feet, and 12 4/5 feet, respectively. In the next group of tab switches, the effective ones pertain to footages of 1 ⅜ feet, 4 feet, and 10 ⅔ feet, respectively; and in the final group, the effective tab switches pertain to footages of 1 ⅓ feet, 3 1/5 feet, and 8 feet, respectively.

The footage switches are multiplexed by a system indicated at 30 in FIG. 1 and at 74 in FIG. 2.

The footage switches 80 (FIG. 3) are supplied at one side with a constant signal voltage Vcc via the resistors 82 and on the other side are connected via respective diodes 84 with the four lines marked A, B, C, and D in FIG. 3. Each of the aforesaid lines are connected to the cathode sides of the isolating diodes of the switches of the respective group of tab switches.

The opposite sides of the footage switches, i.e., the sides which are supplied with signal voltages via resistors 82, are connected so that the corresponding footage switches of the respective groups are connected to the wires E, F, G, and H. The line F is, thus, connected to the lowermost footage switch of each group and line F to the next adjacent switch of each group of footage switches, and so on. Each of the wires, E, F, G, and H is connected through a respective inverter 54 to a four line to one line multiplexer 86 (74153) having an output line 88.

The wires A, B, C and D, on the other hand, form the output sides of a dual one of four decoder 90 (74155) having input lines 91 and 92 which are two of the output lines of a counter encoder 94 (7493). Encoder 94 is supplied with clock pulses from master clock 16 and which master clock, it will be noted, also supplies pulses to the multiplexer 86.

Two more of the output lines 93 and 95 from counter encoder 94 are conveyed to multiplexer component 86 and all four lines from counter encoder 94 are supplied to the inputs of a NAND gate 96. Encoder 94 counts the pulses supplied thereto from clock 16 and converts the count to binary form which appears as logic signals on wires 91, 92, 93 and 95.

The output line 88 from multiplexer component 86 forms the input for the serially arranged shift register system, generally indicated at 98 (74198). The shift register arrangement at 98 has as many outputs as there are footage switches, including outputs for the ineffective footage switches, since these outputs are already built into the chips employed. The outputs of shift register 98 are connected to the input sides of latches, or flip flops, generally indicated at 48 (74175), and each having an input terminal at which an effective signal is developed when the aforementioned system detects a footage switch in closed condition. When a respective footage switch is not in closed condition, the corresponding terminal of the latches, or flip flops, 48, does not develop an effective signal.

The output lines from the latches, or flip flops, at 48, and which are identified by legends indicating the respective footages, and with those terminals which are not being employed being marked X, represent the input via cable 72 to the gating network at 70.

It will be noted that the shift register at 98 is continuously supplied with pulses from master clock 16 so that the multiplexed signal supplied to the one end of the shift register shifts progressively toward the other end thereof. When the shift register is completely filled, indicating that a scan of all of the footage switches has been completed, a pulse from NAND gate 96, which occurs on count 15 of counter 94 is supplied to the clock terminals of the latches, or flip flops, 48, and transfers the data in the shift register to the output terminals of the flip flops. The counter 94 now goes back to zero and a new scan of the footage switches begins. The data at the output sides of the flip flops 48 is, thus, continuously updated each time a scan of the footage switches is completed.

Figure 4:
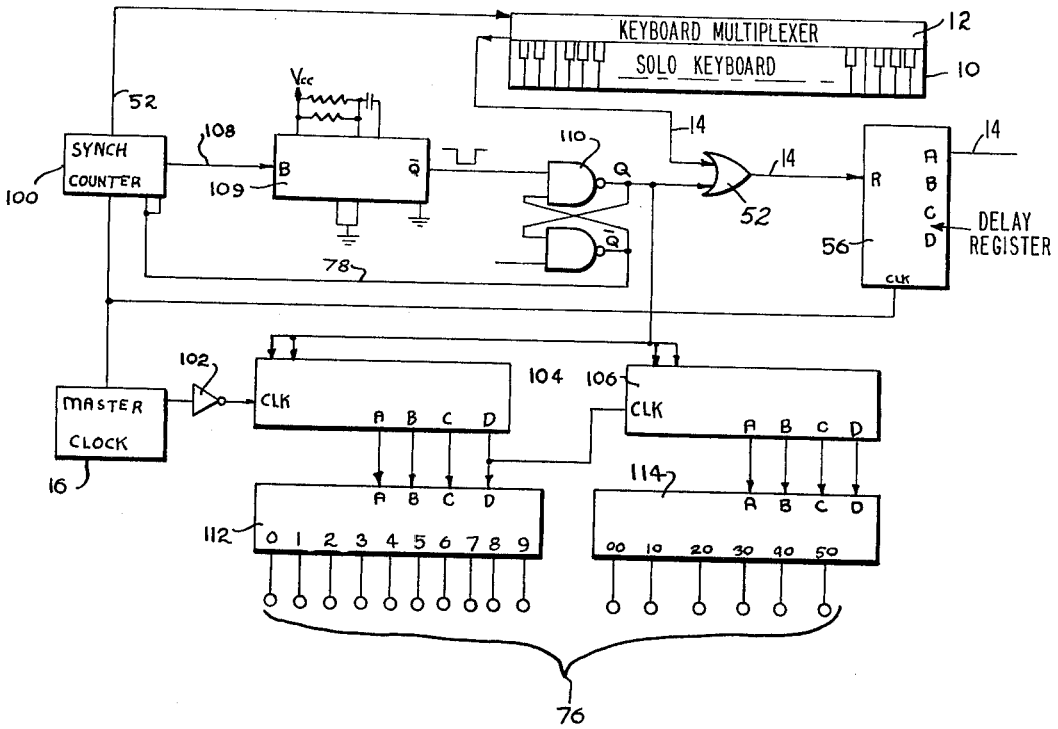
FIG. 4 is a schematic of the control circuit of the present invention.

Turning now to FIG. 4, the keyboard 10 is schematically illustrated and directly adjacent thereto is the multiplexer circuit 12. In FIG. 4, it will be noted that the master clock 16 supplies pulses to a sync counter 100, having outputs 18 and 53 the purpose of which counter is to insure that the keyboard is scanned a single time and the scanning then be interrupted for a predetermined length of time or interval while the keyboard data stream is shifted along the length of shift register 50.

Master clock 16 also supplies pulses via an inverter 102 to the serially connected counters 104 and 106 (7490).

In operation, counter 100 supplies 61 counts via line 53 to multiplexer 12 and on the 61st count, also supplies a signal via line 18 to multivibrater 109 (74121) which, in turn, pulses, via wire 111, to one input of an R-S flip flop 110. This pulse causes the flip flop 110 to change states and its Q output goes high, while the $\overline{Q}$ output goes low. When the Q output goes high, the output of the OR gate 52, which receives the multiplexed keyboard data at one input, goes high, thereby interrupting the supply of keyboard data to the delay register 56, previously referred to. The Q output of flip flop 110, via wire 113, also releases counters 104 and 106, which had previously been setting on count 99 so that these counters commence to run. At the same time the $\overline{Q}$ output is fed back to counter 100 via wire 79 and will hold this counter at count 60. Delay register 56 is interposed between gate 52 and shift register 50, to provide a one bit delay in the movement of data so that when, on the next pulse, counters 104 and 106 go to count zero, the data in shift register 50 is in the leftmost position therein.

The counters 104 and 106 (FIG. 4) are serially connected and drive decoders 112 and 114 (7442) with the outputs from decoder 112 representing integers and the outputs from decoder 114 representing units of 10. The outputs from the decoders represent the cable 76 leading to gating network 70 of FIGS. 2 and 5.

Figure 5:
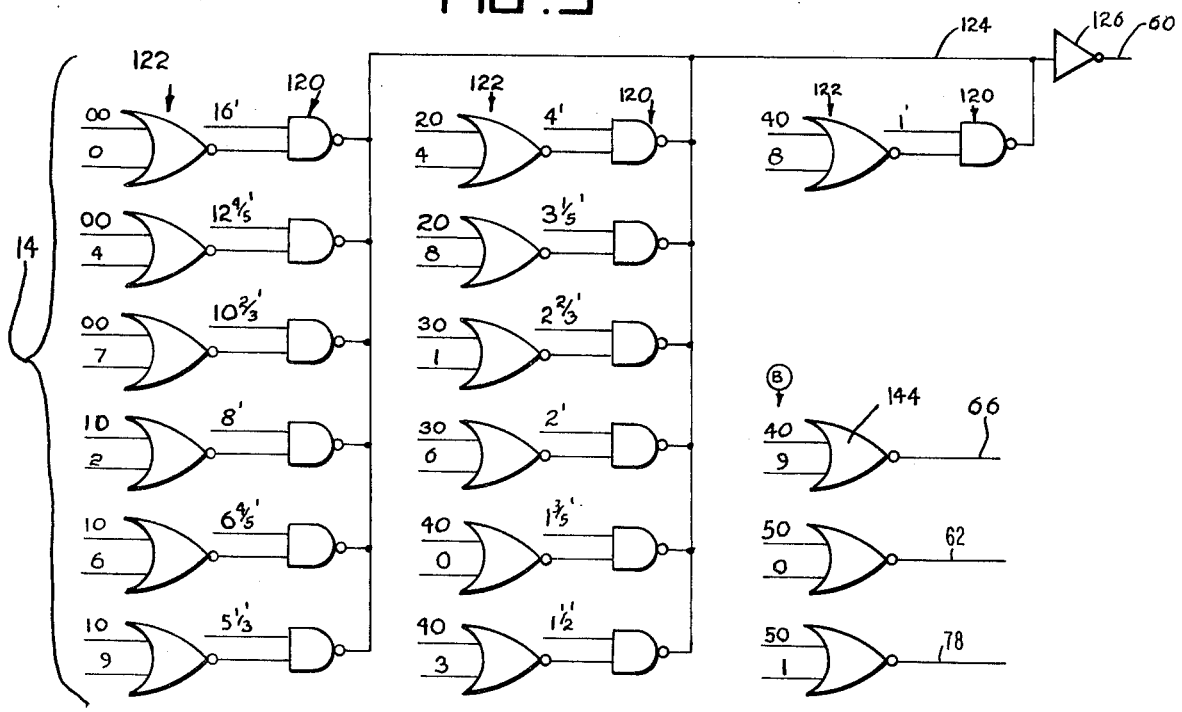
FIG. 5 is a schematic showing the gating circuit of the present invention.

FIG. 5 illustrates schematically the gating network identified at 70 in FIG. 2 and which, on the one hand, is supplied via cable 76 with the outputs of decoders 112 and 114 and, on the other hand, is supplied by cable 72 representing the outputs of flip flops 48 of FIG. 3.

In FIG. 5, each of the effective outputs from the flip flops 48, and which outputs make up cable 72 is connected to one input of a respective NAND gate 120; one NAND gate corresponding to each footage desired with the respective footages being indicated by the legend adjacent said one input terminal of the respective NAND gate. The input terminals of NAND gates 120 with footages marked thereon form the output terminals of the pertaining flip flops 48 of FIG. 3 and which have corresponding legends adjacent thereto. The other input terminal of each NAND gate 120 is connected to the output terminal of a respective NOR gate 122. The inputs of the NOR gates 122 are connected to the output terminals of the decoders 112 and 114 via cable 76 so that an enabling signal is transmitted via each NOR gate 122 to an input terminal of a respective NAND gate 120 at the proper time. The numbers on the inputs of the NOR gates 122 correspond to the numbers on the outputs of decoders 112, 114 to which the NOR gate inputs are connected.

For example, the first footage switch to be checked is the sixteen foot footage switch and it will be noted that the NOR gate 122 corresponding to the sixteen foot footage is enabled on the zero count of the decoders 112 and 114. This count corresponds to the first, or unshifted, position of the keyboard data in the shift register.

Each of the others of the NOR gates 122 are connected to the proper terminals of decoders 112 and 114 so as to supply enabling signals to the respective NAND gates 120 at the proper time. For example, it will be noted that for the eight foot footage, the respective NOR gate becomes effective only on count twelve of decoder 112, 114, indicating that the data stream in the shift register pertaining to the keyboard multiplexer has advanced 12 half steps, or one octave, in the shift register 50.

The output sides of the NAND gates 120 are interconnected via a wire 124 to the input side of an invertor 126, the output side of which is line 60 leading to the clock terminals of temporary latches 58. At this point, it will be seen that when the keyboard data in shift register 50 has shifted to a position therein corresponding to a footage switch in effective position a pulse will be supplied via line 60 to the clock terminals of temporary latches 58 so that the key down signals in the stream of keyboard data in the shift register will move in parallel movement to the temporary latches.

Figure 6:
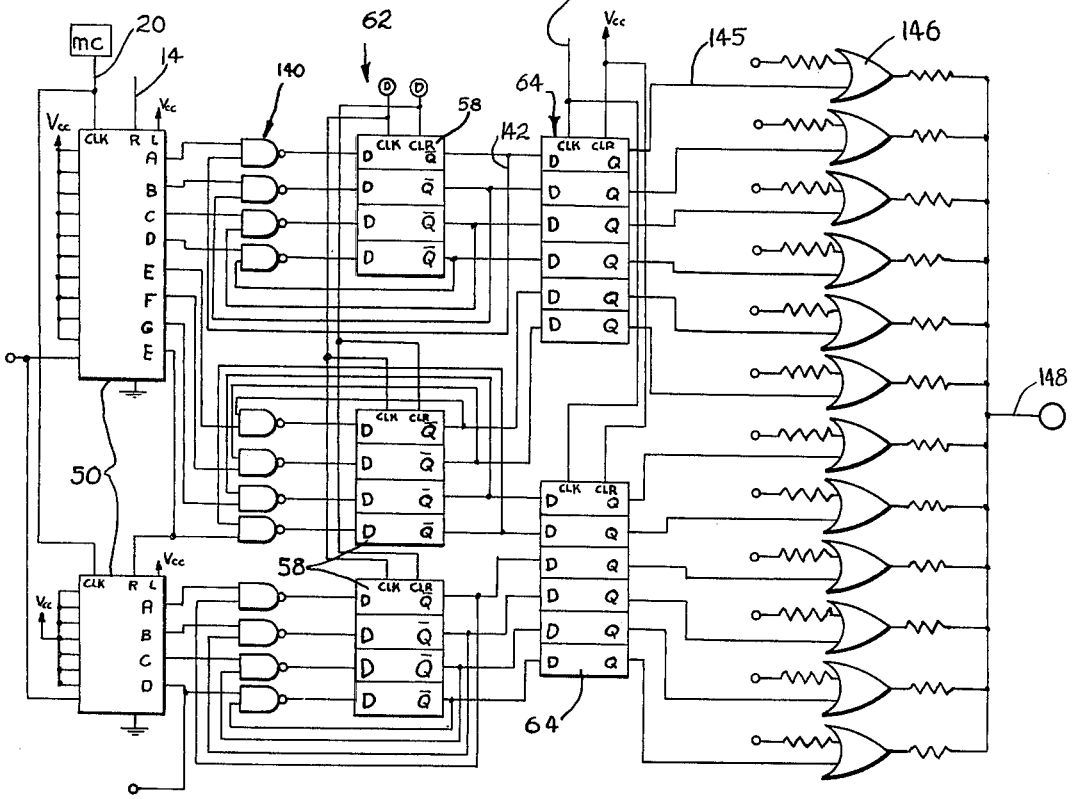
FIG. 6 is a schematic of a portion of the latching circuits used in the present invention.

Turning now to FIG. 6, the shift register 50, the temporary latches 58, and the memory latches 64, and a group of keyers at 146, and forming a part of unit 22 is illustrated in detail.

In FIG. 6, the shift register arrangement 50 which receives the keyboard data via line 14, or gate 52 and delay register 56 and the data stream is clock pulsed along the shift register by pulses on line 20 as illustrated. The shift register and the two groups of latches each have one hundred nine data stations, or stages, therein but only a few thereof are illustrated in FIG. 6 for purposes of clarity.

Since a composite pattern is to be built up in the temporary latches, it is important that any item of data, representing a key depressed, that is inserted into a temporary latch, be retained therein during further shifting of the keyboard pattern in shift register 50. To accomplish this, each latch of the group of temporary latches has a clamp to clamp effective data therein.

Thus, each output terminal of shift register 50 is connected to one input of a respective NAND gate 140, the output terminal of which is connected to the input side of the respective temporary latch 58. When the clock line of the temporary latch is pulsed and the data standing at the input side of the temporary latch is transmitted to the output side thereof, a wire, or a connection, 142 leading from the output side of each temporary latch is conveyed back to the other input terminal of the respective NAND gate 140, therby clamping the data item in the respective temporary latch until the latch is subsequently cleared of data.

In this manner, a signal in the shift register corresponding to a depressed key, is inserted into a respective temporary latch and is clamped therein in each position of the data stream in the shift register which corresponds to a footage switch which is in effective position. In this manner, a composite data signal is built up within the temporary latches.

When the pattern of data signals in the shift register has been shifted 48 steps therein, a clock pulse derived from a NOR gate 144 (FIG. 5) connected to receive a count on count 49 of decoders 112 and 114 is supplied via liine 66 to the clock terminals of memory 64 and which will effect bodily entry in parallel motion of the composite data signal from temporary latches 58 into respective memory latches 64, memory latches 64 have outputs connected via wires 145, with input terminals of respective OR gates, or keyers, 146, the other input terminals of which are supplied witih tone signals of respective frequency. The OR gate 146, thus, form electronic keyers and the output sides thereof are connected to a wire 148 which will be seen hereinafter to lead to voice formant circuit 32.

A further NOR gate 144' (FIG. 5) is enabled on count 50 of decoders 112 and 114 and supplies a signal via wire 62 to the clear terminal of temporary latches 58 and thereby clears data from the said latches.

Finally NOR gate 144'' (FIG. 5) is enabled on count 51 of decoders 112 and 114 and supplies a signal via wire 63 to the reset terminal of flip flop 110 which will drive the Q output low and the $\overline{Q}$ output high. When the Q output of flip flop 110 goes low, OR gate 52 is again enabled for passing keyboard data and when $\overline{Q}$ output of flip flop 110 goes high, sync counter 100 is rest to 0, by the signal on wire 78, and a new scan of the keyboard is initiated.

To summarize the operation of the system up to this point, the footage switches are scanned and multiplexed continuously and the data conforming to the actuated positions of the footage switches is stored and is updated at the end of each scan of the switches.

The keyboard is scanned and multiplexed and the stream of data from the operation is inserted in serial flow into a shift register, the clock terminal of which is continuously supplied with clock pulses. At the completion of a scan of the keyboard, the scanning of the keyboard is interrupted and a scan of the stored data pertaining to the footage switches initiated. Simultaneously, the shift register is being pulsed by the master clock so that data in the shift register moves in synchronisim with the scan of the data pertaining to the footage switches.

Each time a data item corresponding to a footage switch in acutated position is located during the scan of the footage switch data, a clock pulse is supplied to the clock terminals of first latches (input latches or latches for temporary storage of data) connected to the respective stages of the shift register.

At the end of a complete scan of the data pertaining to the footage switches, a pulse is supplied to the clock terminals of second latches (memory or output latches) and the data accumulated in the first latches transfers in parallel flow into the second latches. The second latches have outputs connected to respective keyers and when a data item corresponding to a key depressed is transferred from a first latch to the respective second latch, the keyer corresponding to the second latch is enabled for passing the respectiive tone signal key supplied thereto.

The pulse following the pulse supplied to the clock terminals of the second latches is supplied to the clear terminals of the first latches and erases all data from the first latches. The next following pulse is effective for interrupting the scan of the stored data pertaining to the footage switches and to initiate a fresh scan of the keyboard.

From the foregoing summary, it will be seen that the shift register in which the stream of keyboard data is inserted is pulsed continuously and that the footage switches are scanned continuously and the data corresponding thereto is stored and updated at the end of each scan of the switches.

The scanning of the keyboard is, however, intermittent, or cyclical, and, in the interval between successive keyboard scans, the data corresponding to the footage switches is scanned and the clock terminals of the first, or input, latches are pulsed in conformity with the footage switch data.

The clock terminal of the second, or output, latches is pulsed after the scan of the footage switch data is completed, the first, or input, latches are then cleared, and a fresh scan of the keyboard is then initiated. The foregoing cycle is repetitive throughout the time the organ is in operation.

Figure 7:
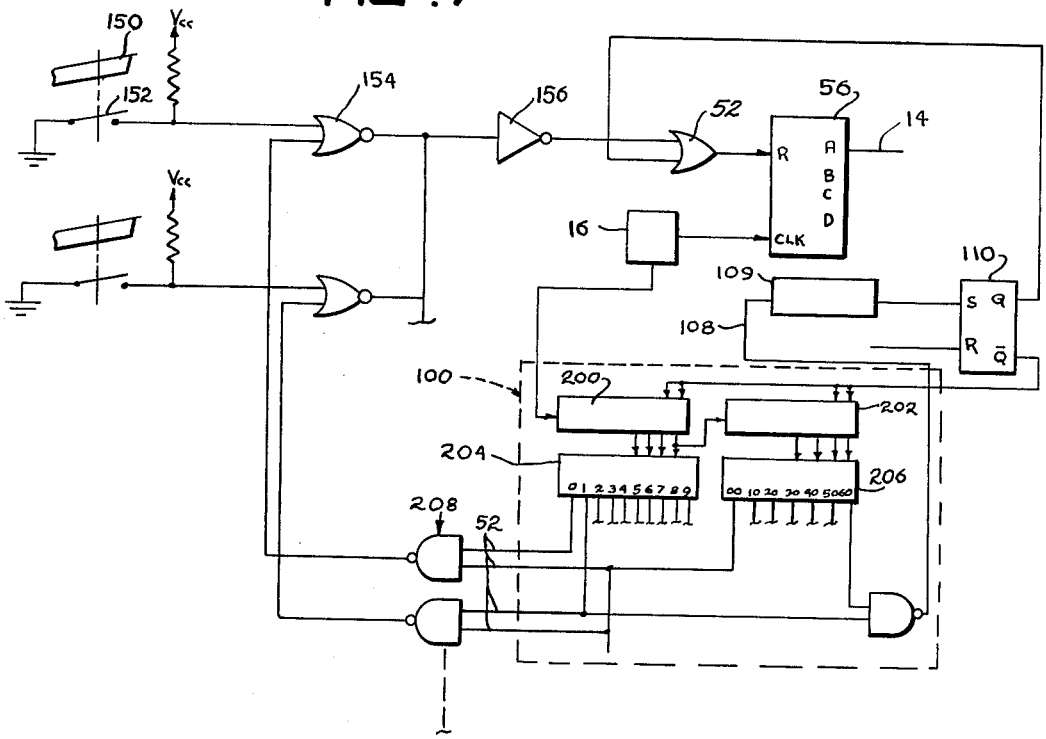
FIG. 7 is a schematic showing a portion of a multiplexing circuit which could be used to produce keyboard data for use in the present invention.

FIG. 7 illustrates schematically one manner in which the keyboard of the organ could be multiplexed to provide for the series of signals which are supplied to the shift register 50. Other arrangements for multiplexing the keyboard are possible, including a multiplexing arrangement similar to that previously described in respect of FIG. 3.

FIG. 7 merely shows an alternative way of arriving at a multiplexed signal corresponding to the depressed keys of the keyboard. In FIG. 7, each key 150 of the keyboard controls a switch 152. Each switch is connected to one terminal of a NOR gate 154 with the outputs of the NOR gates interconnected and supplied to the input terminal of an invertor 156. The output side of inverter 156 is connected to the input terminal of a NOR gate 158, the other input terminal of which is supplied from the output side of the aforementioned R-S flip flop 110 so that NOR gate 158 is effective for transmitting signals for 61 counts only and which represents one complete scan of the keyboard.

The second input terminal to each NOR gate 154 is connected to the output of a NAND gate 208, with the inputs to each NAND gate coming from the outputs of decoders 204 and 206. Decoders 204 and 206 are driven by counters 200 and 202 to count from 0 to 63. The interconnection between NAND gates 208 and decoders 204 and 206 is such that one NAND gate will pulse its output line on each count from 0 to 60. The pulse on each NAND gate output line enables one of the NOR gates 154 for the duration of a respective pulse. In this manner, the NOR gates 154 are enabled sequentially, thus scanning the keyboard for multiplexing purposes.

Figure 8:
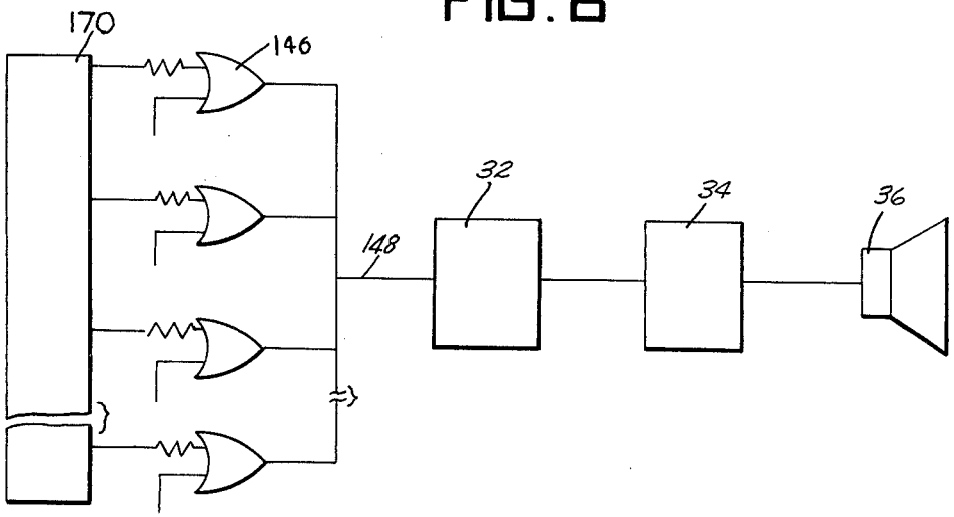
FIG. 8 is a simplified schematic showing the routing of signals from the tone generators to the speaker circuits.

FIG. 8 schematically shows the connections of keyers 146 between the output terminals of synthesizer 26, and which output terminals are at respective frequencies, and the input side of a voice formant circuit 32, the output side of which is connected to the input side of an amplifier 34, the output side of which is connected to the input side of speaker means 36. As mentioned, synthesizer 26, or whatever tone generator is employed supplies one hundred nine pitches separated from each other by intervals of one-half step.

Figure 9:
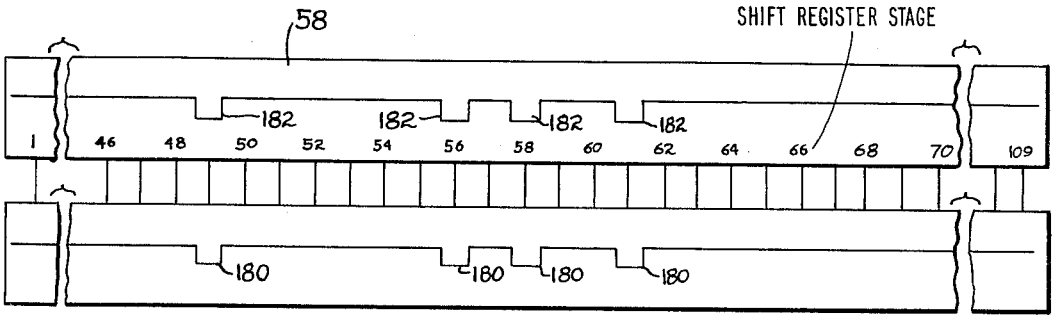
FIGS. 9 and 10 are block diagrams depicting the entering of data which is in the shift register into the temporary latches in two shifted positions of the data.
Figure 10:
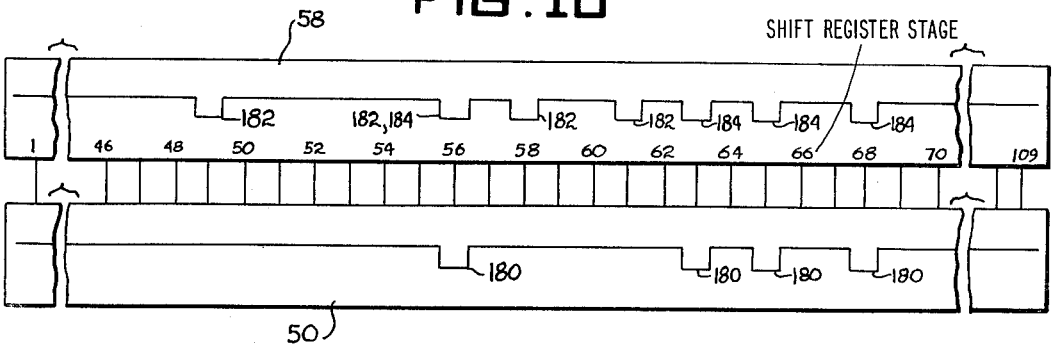

FIGS. 9 and 10 illustrate schematically the manner in which a composite signal is built up in the temprary latches. In these figures, number 50 designates the shift register to which the keyboard data is supplied and reference numeral 58 desigantes the temporary latches. The steps along the shift register are indicated by the row of numbers above the vertical lines connecting the shift register 50 with latches 58.

In FIG. 9, the key down signals in the stream of keyboard data are represented by the signals 180, which correspond to depressed keys, with the spacing between signals 180 representing noneffective second signals corresponding to nondepressed keys. The signal data pattern in shift register 50 in FIG. 9 could represent, for example, the initial position occupied by the data stream in the shift register when one scan of the keyboard is completed. If, at this time, the sixteen foot footage switch is depressed, the signals 180 will be transmitted in parallel movement into temporary latches 58. The signals in temporary latches 58 which correspond to signal 180 in register 50 and are designated 182.

The shift register is constantly pulsed so that the data pattern therein will move toward the higher pitch end therof, namely, toward the right, in FIGS. 9 and 10. If, for example, the shift register is pulsed seven times, the data therein will move rightwardly seven steps and will be in the position corresponding to the 10⅔ ft. footage switch. If this footage switch is down, i.e., closed, the data in the shift register 50 will again transfer to the temporary latches 58.

In FIG. 10, the keyboard data pattern in shift regisiter 50, and again represented by signals 180, will be seen to be shifted seven steps rightwardly from its FIG. 9 position and, with the 10⅔ ft. footage switch in effective position, this data will be entered into temporary latches 58 in parallel motion and establish a further series of signals therein and which are indicated at 184. It will be noted that one of the signals 182 corresponds to a signal 184 and is superimposed thereon but inasmuch as the original signal was clamped in the respective temporary latch there is no change in the data pattern in the respective temporary latch at this time.

Figure 11:
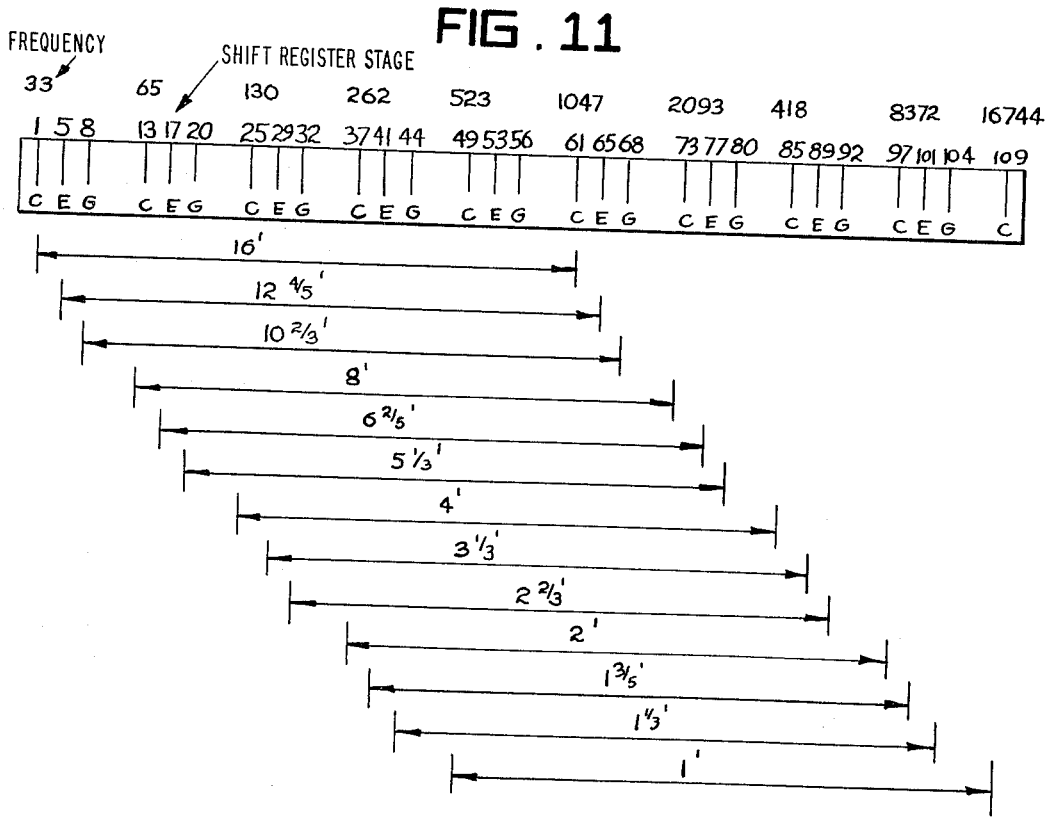
FIG. 11 is a diagram showing the relation in frequency between various footages of an organ.

FIG. 11 schematically illustrates the position of the keyboard data along the shift register for different given footages for the organ. In this Figure certain ones of the pitches are identified by the letters C, E and G for the sake of clarity and the range along the bank of keyers in which each footage is played is indiciated. Furthermore, the steps, or stages, along the shift register or the latches or keys corresponding to the pitches indicated are identified by the row of numbers marked (STEP) and the frequencies corresponding to certain ones of the steps are also identified by the numbers marked (FREQ).

Figure 12:
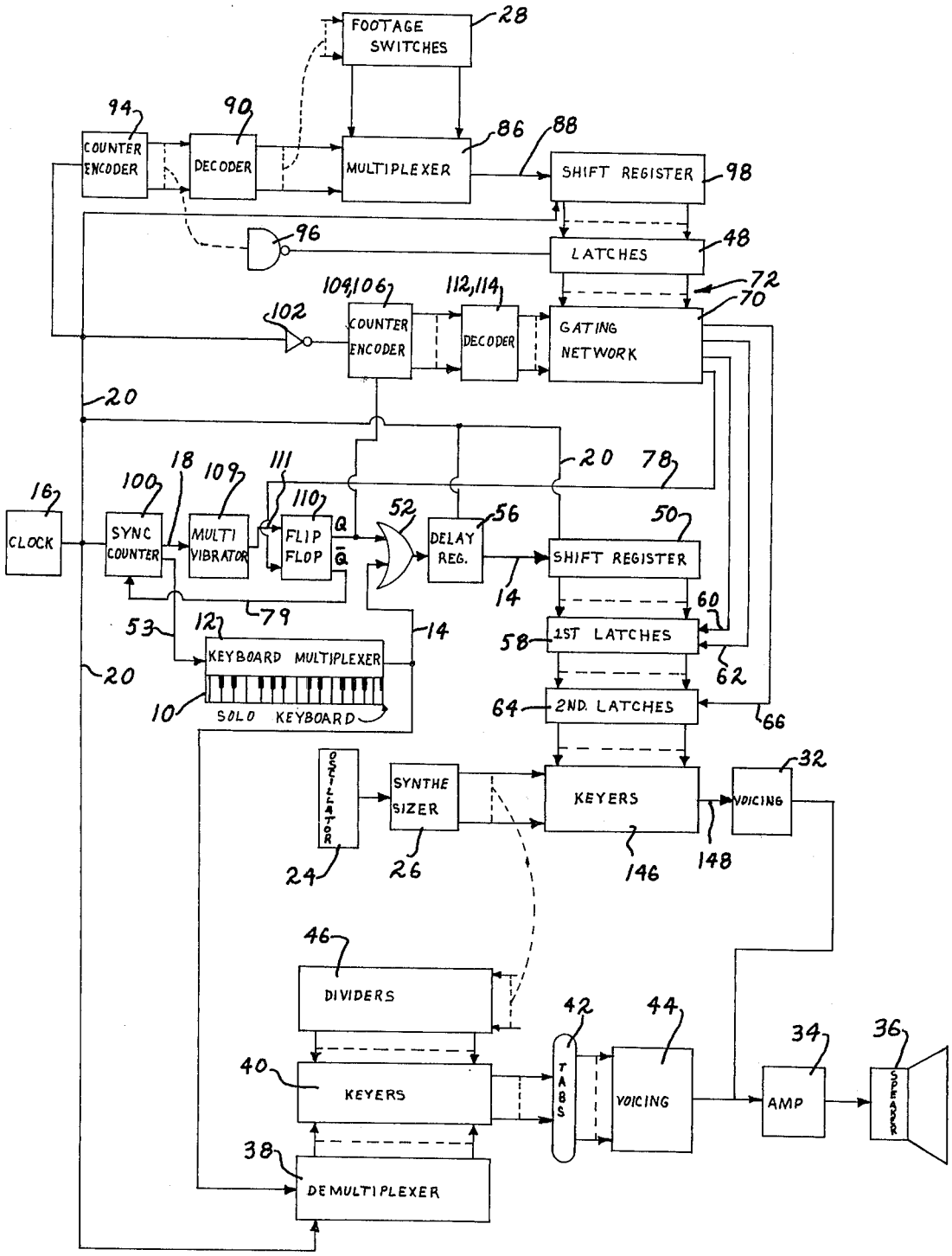
FIG. 12 is a further block diagram of an organ circuit according to the present invention.

FIG. 12 is a further block diagram in which the signal flow is more closely related to the detailed showings of FIGS. 3 to 6.

In FIG. 12, it will be noted that clock 16 supplies multiplexer 86 and also supplies counter encoder 94 which, in turn, is connected in controlling relation to NAND gate 96 and decoder 90 which latter is also connected to multiplexer 86. Multiplexer 86 is connected with footage switches 28 and supplies signals to shift register 98 which, in turn, supplies signals to flip flops or latches 48. The foregoing components are illustrated in FIG. 3 of the drawings in detailed form.

FIG. 12 also shows that master clock 16 supplies sync counter 100 and which has one output line 53 connected to multiplexer 12 for keyboard 10. Sync counter 100 also supplies a signal to multivibrator 109 on a predetermined count which occurs at the end of a scan of the keyboard with multivibrator 109 being connected to one input terminal of RS flip flop 110. One output of flip flop 110 is connected to one input terminal of OR gate 52, the other terminal of which is connected to wire 14 leading out of multiplexer 12. The other output of flip flop 110 at $\overline{Q}$ is connected by wire 79 back to synch counter 100 for halting the synch counter simultaneously with disabling gates 52.

The output from gate 52 is supplied to a one bit delay register and which is also connected to line 20 leading from clock 16.

The Q output from flip flop 110 which is connected to the one input of NOR gate 52 is also connected to a counter encoder 104, 106 which supplies decoder 112, 114. The counter encoder is continuously supplied with clock pulses from wire 20 via invertor 102 but only runs during the time that NOR gate 52 is disabled. The counter encoder commences to run when OR gate 52 is disabled and stops running when the flip flop returns to its original condition by way of a signal supplied to the other input thereof by way of a wire 78.

The components described immediately above are disclosed in detail in FIG. 4 of the drawings.

The output from delay register 54 is supplied to one end of shift register 50 which is continuously supplied with clock pulses via wire 20 so that the data stream supplied to one end thereof by wire 14 is entered therein and is then continuously shifted bodily along the shift register toward the other end thereof.

Connected in one to one relation with the stages of the shift register are first latches 58, each of which latches has a clamp means associated therewith to clamp effective signals in the respective latch.

Latches 58 are arranged in one to one relation with second latches 64 and second latches 64 are arranged in one to one relation witih keyers 146, each of which keys a respective pitch when actuated.

The components described immediately above are shown in detail in FIG. 6 of the drawings.

The gating network at 70 receives inputs by way of cable 46 from decoders 112, 114 and inputs from latches 48 by way of cable 72. The gating network 70 has one output represented by wire 60 and connected to the clocking input of the first latches 58 and has a second output in the form of wire 62 connected to the clear input of first latches 58.

A further output from the gating network is connected by wire 66 to the clocking input of second latches 64 and a fourth output from gating network 70 is connected by wire 78 to the other input of flip flop 110. The gating network 70 is shown in detail in FIG. 5 of the drawings.

The keyers 146 have one terminal connected to a source of tone signals which, in FIG. 12, is indicated as the combination of an oscillator 24 and a synthesizer 26 and is illustrated in FIG. 8 as the tone generator 170 having terminals at respective pitches. The other terminal of each keyer is connected to a respective one of second latches 64. The output sides of the keyers are connected by wire 148 to a voicing circuit 32 and from there through amplifier 34 to speaker 36.

The components referred to immediately above are illustrated in FIG. 8 of the drawings.

The components 38, 40, 42, 44 and 46 of FIG. 12 are similarly schematically illustrated in FIG. 1 of the drawings but, as mentioned, form no part of the present invention and are merely shown to provide for a more complete illustration of an electronic organ system.

From the foregoing it will be seen that the present invention provides a relatively simple system that can be applied to an electronic organ whereby a great deal of complex circuitry and switching is eliminated, while, instead, integrated circuit components in the form of chips are employed.

The routing of the main tone signals is directed from the tone generator via keyers to the voice formant circuit means and then to the amplifier and speaker means. The entire control operation which consists of scanning the keyboard and the footage switches is carried out by simple logic circuitry and which circuitry is then employed for actuating the proper keyers.

In the described manner, an organ circuit can be made which is compact and relatively inexpensive and in which signal distortion is kept to a minimum. At the same time a multiplicity of different footages is possible. The particular example given describes how to develop a plurality of footages for a single voice, but it will be understood that the system of the present invention could be extended to as many voices as desired and the advantage of obtaining a multiplicity of footages pertaining to each voice could be realized.

Modifications may be made within the scope of the appended claims.

What is claimed is:

1. In an electronic organ having a predetermined number of depressable playing keys and a greater number of keyers, each keyer when actuated keying a respective pitch, multiplexing means including a source of clock pulses for scanning said keys, means for interrupting the scanning of said keys at the end of a complete scan thereof, each said scan generating a data stream in which key down signals corresponding to depressed keys appear in respective time slots, a shift register continuously clocked by said source and having a stage for each keyer and connected to receive said data stream at one end and to shift the received data stream bodily therealong, first storage means connected to each stage of the shift register for receiving and storing each key down signal in the shift register in selected shifted positions thereof during said bodily movement of the data stream in the shift register, second storage means connected to each first storage means for receiving the stored key down signals therefrom, each said second storage means upon receiving a key down signal actuating the respective keyer, and means for clearing the key down signals from said first storage means and for initiating a new scan of said keys after the item of said data stream first entered into said one end of said shift register has reached the other end thereof.

2. The method of operating an electronic organ having a keyboard with playing keys, a tone generator developing a plurality of pitches greater in number than said keys and a keyer for keying each pitch; scanning the keyboard a single time to develop a data stream in which key down signals corresponding to depressed keys appear in respective time slots, presenting said data stream to an end stage of a shift register having more stages than there are keys while continuously clocking the register to enter the data stream therein and to shift the data stream bodily therealong, serially connecting first and second latches in the order named between each stage of the shift register and a keyer for a respective pitch, clocking the first latches in selected shifted positions of the data stream in said shift register to insert the key down signals in the shifted positions thereof in the shift register into the first latches, clocking the second latches when the data stream item first entered into the shift register reaches the final stage in the shift register to insert the key down signals in the first latches into the second latches, actuating each keyer in response to the insertion of a key down signal into the respective second latch, then clearing the first latches and initiating another scan of said keyboard.

3. The method according to claim 2 which includes clamping each key down signal inserted into a first latch therein until the first latches are cleared.

4. In an electronic organ having a predetermined number of keys and a greater number of keyers each operable when actuated for keying a respective pitch, scanning means for scanning said keys cyclically with a predetermined time interval between successive scans and having an output at which a data stream is produced on each scan in which key down signals appear in respective time slots, said scanning means having an input and a source of clock pulses connected thereto, a shift register having a stage for each keyer and continuously clocked by pulses from said source, first and second latches connected in series in the order named between each register stage and the respective keyer, first means connecting the output of said scanning means to the stage at one end of the shift register, second means adapted during the interval following each scan to supply at least one pulse from said source to the clock terminals of said first latches to insert therein key down signals in respective stages of said register, third means operable near the end of each interval to supply a pulse from said source to the clock terminals of said second latches to insert therein key down signals in the respective first latches, and fourth means operable immediately prior to the end of each interval to supply a pulse from said source to the clear terminal of said first latches to clear key down signals therefrom, each key down signal inserted in a second latch actuating the respective keyer.

5. An electronic organ according to claim 4 in which each said first latch comprises clamp means to clamp therein key down signals inserted therein until the clear terminals of said first latches are pulsed.

6. An electronic organ according to claim 4 in which said second means includes footage switches each corresponding to a respective position of the data stream in said shift register, each switch having an effective and an ineffective position and a terminal at which a signal is developed when the respective switch is in effective position, means for addressing each said terminal during each said interval when the data stream is in the corresponding position in the shift register, and means responsive to the addressing of a said terminal having a signal for supplying a pulse to the clock terminals of said first latches.

7. An electronic organ according to claim 6 in which said third means comprises means to supply said pulse to the clock terminals of said second latches following the addressing of all of said terminals and prior to the end of the respective interval.

8. An electronic organ according to claim 7 in which said fourth means comprises means to supply the pulse to the clear terminals of said first latches following the supply of the pulse to the clock terminals of said second latches and prior to the end of the respective interval.

9. An electronic organ according to claim 4 in which said first means includes first counting means interposed between said source of clock pulses and the input of said scanning means, said first means including a gate interposed between the output of said scanning means and said shift register, a control element connected to said first counting means for actuation thereby and operable to disable said gate and said first counting means at the end of each complete scan of the keys, said second means including second counting means connected to said source of clock pulses and connected to said control element to be enabled thereby at the end of each scan of the keys, a plurality of footage switches each having an effective and an ineffective position, means operated by said second counting means for addressing said switches sequentially and operable in response to the addressing of a switch in effective position for supply a pulse to the clock terminals of said first latches, said third means comprising means operated by said second counting means for supplying a pulse to the clock terminals of said second latches after all of said switches have been addressed, said fourth means comprising means operated by said second counting means for supplying a pulse to the clear terminals of said first latches following the supply of a pulse to the clock terminals of said second latches, said second counting means being operable after the supply of a pulse to the clear terminals of said first latches to actuate said control element to enable said gate and to disable said second counting means and to enable said first counting means at the starting position thereof.

10. An electronic organ according to claim 9 in which said control element is a flip flop having one input terminal connected to said first counting means and another input terminal connected to said second counting means, said flip flop having output terminals connected in controlling relation to said gate and to said first and second counting means.

11. An electronic organ according to claim 10 which includes a one bit delay register interposed between said gate and said shift register and continuously clocked by said source of clock pulses.

12. An electronic organ according to claim 4 in which there are sixty-one keys, and one hundred nine stages in the shift register.

13. An electronic organ according to claim 4 in which each shifting step of the data stream in the shift register corresponds to a half step of the musical scale, said second means being adapted for supplying a pulse to the clock terminals of said first latches on the first, fifth and eighth steps of each of successive groups of tweleve steps.

* * * * *